US005417605A

United States Patent [19]

Chan

[11] Patent Number: 5,417,605

[45] Date of Patent: May 23, 1995

[54] TOY WITH DANCING FIGURE

[75] Inventor: Albert W. T. Chan, Unionville, Canada

[73] Assignee: Thinkway Trading Corporation, Markham, Canada

[21] Appl. No.: 176,842

[22] Filed: Jan. 3, 1994

[51] Int. Cl.[6] ..... A63H 33/26; G09F 19/00

[52] U.S. Cl. ..... 446/136; 40/426

[58] Field of Search ..... 446/136, 175, 135, 134, 446/133; 40/426, 414, 415

[56] References Cited

U.S. PATENT DOCUMENTS

| | | | |
|---|---|---|---|
| 2,282,430 | 5/1942 | Smith | 446/136 X |
| 2,656,643 | 10/1953 | Brosseit | 446/135 X |
| 3,006,111 | 10/1961 | Koch | 446/136 |
| 4,097,917 | 6/1978 | McCaslin | 446/175 X |
| 4,838,825 | 6/1989 | Hwang et al. | 446/136 |

*Primary Examiner*—Mickey Yu
*Attorney, Agent, or Firm*—Brian W. Gray

[57] ABSTRACT

A toy with a dancing figure on a stage. The toy includes a housing, a dancing stage mounted on the housing with a friction causing upper surface, a dancing figure on the stage a turntable mounted in the housing below the dancing stage, the turntable rotating about its centre in a plane parallel to the plane of the stage, and a few relatively heavy pieces distributed on the upper surface of the turntable so that the centrifugal forces of the turntable am balanced about the its centre of rotation. One of the pieces attached to the turntable is a first magnet having its poles oriented perpendicularly to the plane of the stage. The dancing figure has a second magnet at its base. The second magnet's poles are oriented at right angles to the plane of the dancing stage when the figure is upright, and the polarity of the second magnet is oriented relative to the polarity of the first magnet so that the first and second magnets attract each other. The turntable can be activated in response to sounds or by a switch. The other heavy pieces on the stage may be metal pieces that are weakly attracted and repelled by the second magnet, so that the dancing figure's movements vary accordingly.

8 Claims, 6 Drawing Sheets

TOY WITH DANCING FIGURE

FIELD OF THE INVENTION

This invention relates to the field of toys, particularly sound activated toys with figures that appear to dance to music.

BACKGROUND OF THE INVENTION

Integrated circuits which are activated by sound are well known. Such circuits can activate toy motors in response to sounds to produce dancing toys such as dancing flowers, people or cans.

Takara Co. Ltd. produced a dancing peanut in a jar in 1992 under the trademark NUTTY DANCERS in which sound activates a pre-recorded dance tune and the operation of a motor which causes a magnet to spin. In the Takara article the magnet is mounted on a shaft below a dancing stage and the axis of rotation of this magnet is in a plane parallel to the plane of the dancing stage.

In the Takara article, a toy peanut above the stage having a magnet at the peanut bottom is alternately attracted and repelled by the rotation of the magnet below the dancing stage as the polarity of the magnet presented to the dancing stage is continuously reversed. The peanut thus appears to fall down and get up in response to music. However, because the peanut is alternately repelled and attracted by a magnet which is located centrally of the dancing stage, and which does not move about the plane of the dancing stage, the movement of the peanut is relatively uninteresting. In addition, the alternate attraction and repulsion of the peanut causes it to tall and get up in a relatively predictable and monotonous routine.

The present invention seeks to improve upon the dancing characteristics of a toy figure which appears to dance to music.

SUMMARY OF THE INVENTION

The present invention provides, in one aspect, a toy with a dancing figure comprising a housing, a dancing stage mounted on the housing having a friction causing upper surface, a turntable rotatably mounted about its centre in the housing below the dancing stage and rotating in a plane parallel to the plane of the stage, and at least one relatively heavy piece attached to the upper surface of the turntable, wherein the centrifugal forces of the turntable are substantially equally balanced about the centre of rotation of the turntable. In some aspects of the invention, a plurality of relatively heavy pieces are provided, the pieces being distributed in a manner such that the centrifugal forces of the turntable are substantially equally balanced about the centre of rotation. The at least one piece or at least one of the plurality of pieces is a first magnet attached to the turntable at a point radially outward from the centre of rotation of the turntable, the magnet's poles being oriented along a line substantially perpendicular to the plane of the stage. A dancing figure is provided having at its base a second magnet with its poles oriented at right angles to the plane of the dancing stage when the figure is upright and with the polarity of the second magnet oriented in relation to the polarity of the first magnet so that the first magnet and the second magnet attract each other. Means is provided for turning the turntable. Means is also provided for activating the turntable turning means. The activating means may respond to sounds such as music or may be a switch. In some aspects, both sound-responsive activating means and a switch may be provided. The dancing figure may have a relatively low centre of gravity.

This toy differs from the previously existing magnetically driven dancing figures (particularly the Takara dancing peanut previously mentioned) in that the magnet is mounted on a turntable which turns in a plane parallel to the plane of the dancing stage. Further, the polarity of the first magnet presented to the dancing stage is not reversed but remains the same, i.e., opposite to the polarity of the second magnet at the bottom of the figure, so that the magnet on the turntable and the magnet on the figure are continuously attracted to each other. The distance of the magnet from the underside of the dancing stage, the strength of the magnet, the speed of the rotation of the turntable and the roughness of the dancing surface are all balanced so that the dancing figure is attracted to the first magnet but not so strongly that it binds to and follows automatically the magnet turning below the dancing stage. The roughness of the dancing stage and the speed of the moving magnet on the turntable renders it difficult for the figure to move precisely along with the movement of the magnet of the turntable.

In a preferred aspect of the invention the heavy pieces are metal and preferably of a kind which attracts magnets so that the magnet of the dancing figure is also attracted to those pieces, but to a weaker degree than the magnet on the turntable and the magnet in the dancing figure are attracted to each other. This also helps to create varied and fluctuating magnetic fields along the surface of the dancing stage, which fields cause the figure to dance in more varied and interesting ways. The relative weight of the pieces balances the weight distribution so that the turntable spins without rocking. Metal is a preferred material for the heavy pieces because of its convenience, density and cost. However, other materials can be used, though such materials would not provide the additional varied dance movements described above.

BRIEF DESCRIPTION OF THE DRAWINGS

For a better understanding of the present invention and to show more clearly how it may be carried into effect, reference will now be made by way of example to the accompanying drawings, which show a toy according to the preferred embodiment of the present invention and in which.

DETAILED DESCRIPTION OF PREFERRED EMBODIMENTS

Figure 1:
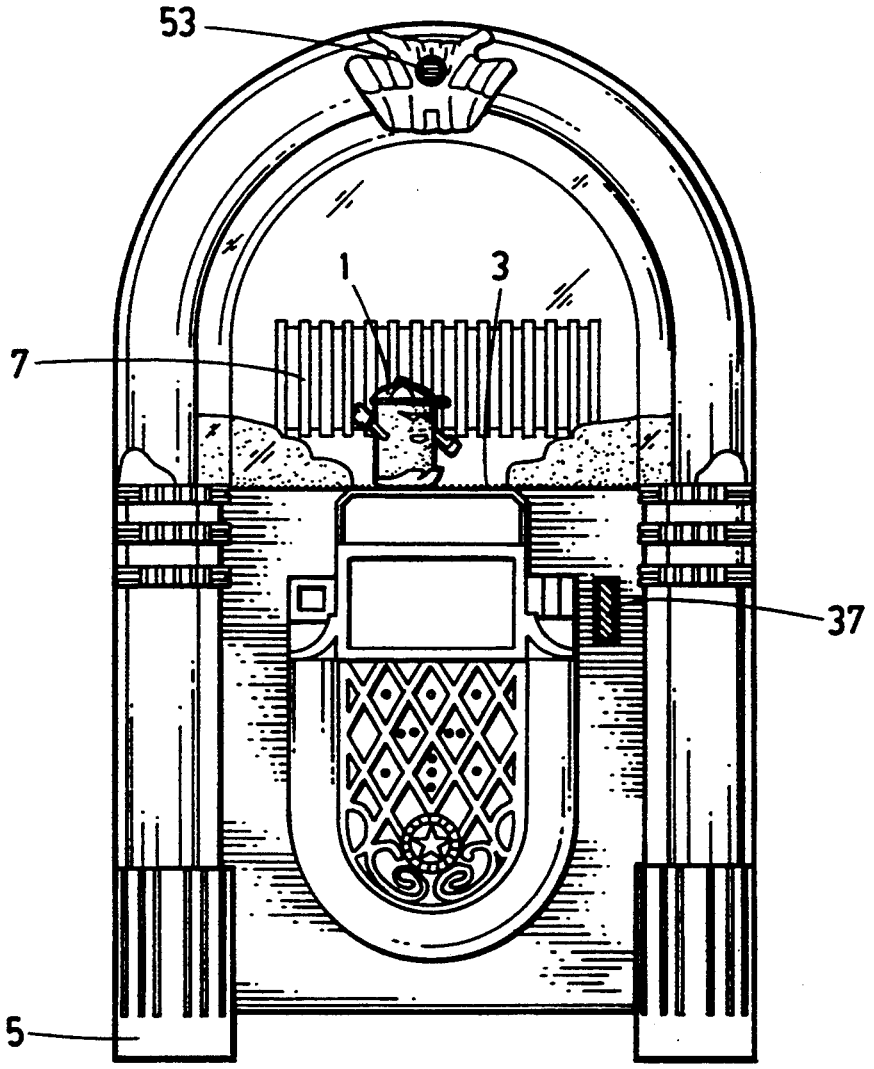
FIG. 1 is a front view of a toy juke box according to the invention having a dancing stage and figure.

A housing for the dancing stage of the present invention can be any appropriate configuration. It can be designed as a juke box or theatrical stage or it can be any other container, such as a bubble gum or other confectionery dispenser or any clear plastic container. Shown in FIG. 1 is the design of a juke box housing containing dancing FIG. 1 oil dancing stage 3. The article is in the commonly known shape of a juke box and is slightly raised off the floor by legs 5, as can best be seen in FIG. 2. Behind the stage and mounted on a wall so as not to interfere with the dancing figure is a design of a CD rack 7. FIG. 3 shows the juke box in cross-section with the dancing FIG. 1.

The dancing stage 3 is made of any rough surface, preferably a rough textured paper or a rough cloth. It could also be a plastic surface containing bumps or any other friction inducing surface.

Figure 4:
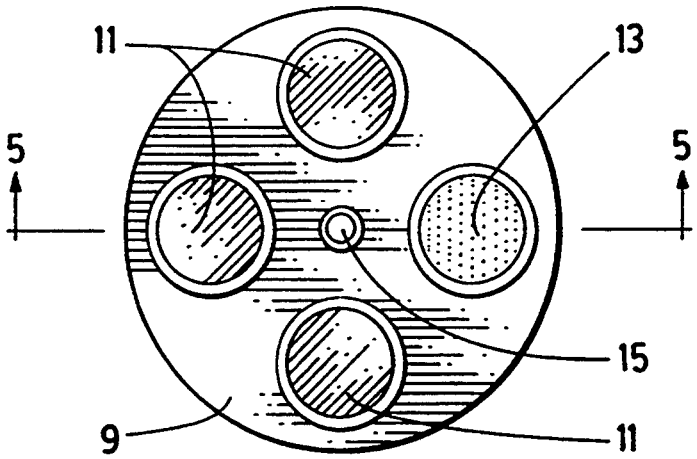
FIG. 4 is a top plan view of a turntable according to the invention.
Figure 5:
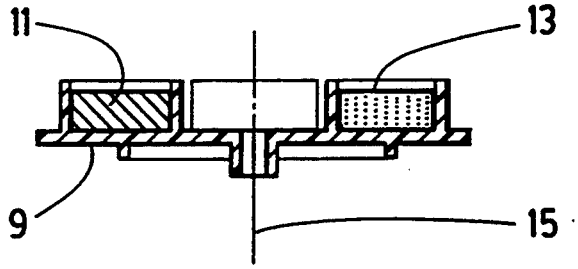
FIG. 5 is a sectional view of the turntable along lines 5—5 of FIG. 4.

Below the stage is a turntable 9 in which are placed relatively heavy pieces such as metal pieces 11, as best shown in FIG. 4. Preferably all of the pieces are of a metal of the same size and at least one of them is a magnet. In FIG. 4, one metal piece 13 is a first magnet and the others are of a kind of metal that attracts a magnet but are not themselves magnets. The poles of magnet 13 are oriented in a line perpendicular to the plane of turntable 9. The turntable, which is shown in cross-section in FIG. 5, is in a plane parallel to and slightly below the plane of dancing stage 3. In one embodiment, the turntable is positioned such that the distance between the top of the magnet 13 and the bottom of the dancing stage is approximately 7.25 millimetres. The magnet 13 and the metal pieces 11 are of all approximately the same size and weight and are placed radially and circumferentially around the turntable 9 so that the turntable is balanced about its axis of rotation 15. It is possible for more or less than four metal pieces or even no metal pieces to be used, as long as the turntable is balanced, but it is preferable for movement of the dancing figure that there be metal pieces to attract a magnet in the dancing figure and that there be sufficient space between the pieces to allow the magnetic field to weaken at some points during the turntable's rotation. As an example, the orientation of the magnet 13 could be arranged so that its north pole is up and its south pole is attached to the face of the turntable.

Figure 6:
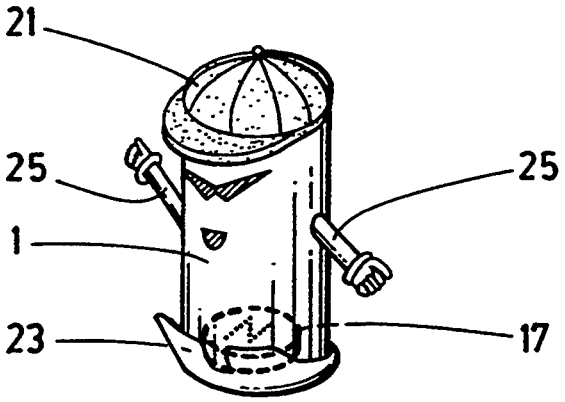
FIG. 6 is a perspective view of a dancing figure according to the invention.
Figure 7:
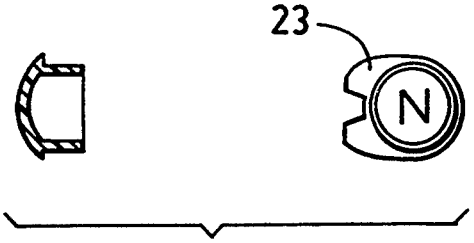
FIG. 7 is a sectional view of the dancing figure of FIG. 6.

The dancing FIG. 1 is shown in FIG. 6 and, in cross-section, in FIG. 7. It contains within it (in dotted outline) a second magnet 17. In the example given above in which the first turntable magnet has its north pole upwardly and its south pole attached to the turntable, the second magnet in the dancing figure would also be oriented in this way, so that the south pole of the magnet 17 faces downwardly towards the dancing stage so as to attract and be attracted by the north pole of the magnet 13 on the turntable below the dancing stage. In other embodiments of the invention, the two magnets may be oriented differently, but they are still oriented relative to each other such that a pole of the first magnet attracts and is attracted by the opposite pole of the second magnet.

The two magnets are of a strength and are oriented at a distance from each other such that their attraction provides for dancing of the figure. The attraction of the magnets for each other must not be too weak, so that the figure cannot respond to the turntable movement. The attraction must not be too strong, so that the device is fixed in position. In the preferred embodiment, the two magnets are of the same grade and material, but the turntable magnet is larger. In other embodiments of the invention, different magnet pairs may be used. This may affect the permissable distance between the top of the magnet 13 and the bottom of the dancing stage.

The FIG. 1 is preferably made of soft PVC plastic but has a hard cap 21 and hard plastic feet 23. Because the magnet 17 weighs considerably more than the rest of the figure, the centre of gravity of the figure is relatively low which assists the figure, when it has fallen, in righting itself in response to the magnetic forces. Decorative plastic arms 25 are also provided.

Figure 9:
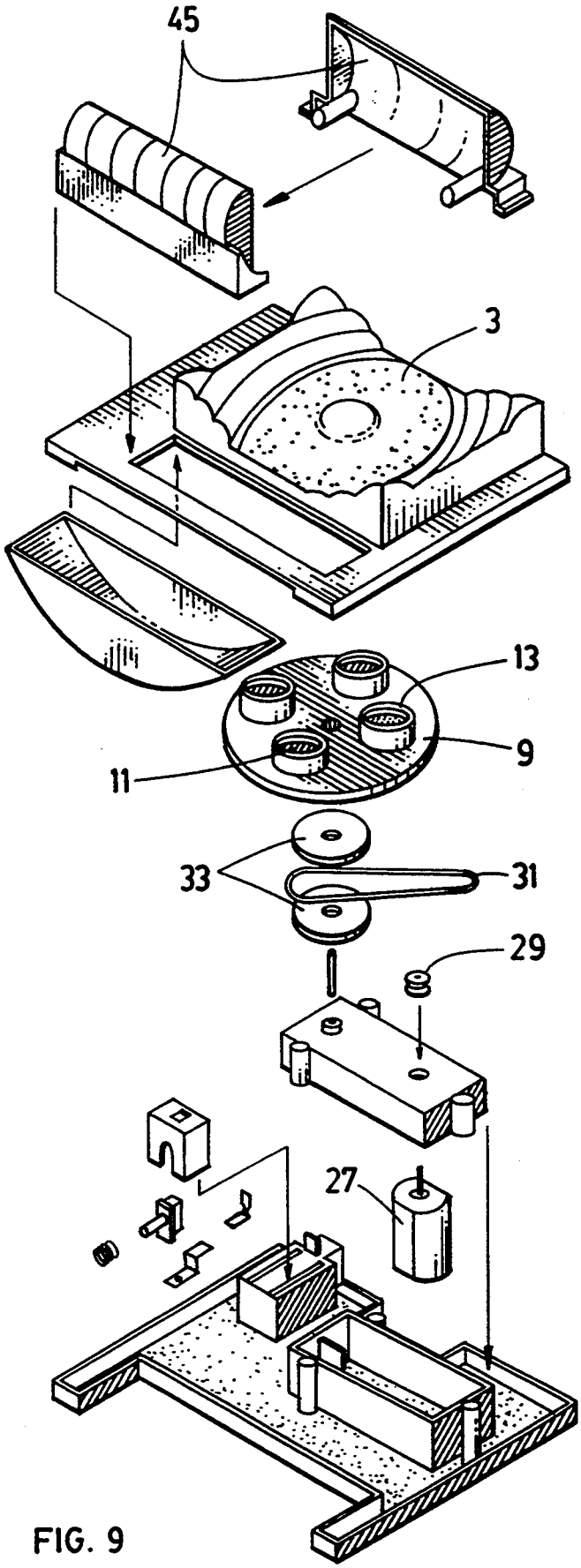
FIG. 9 is an exploded perspective view of a portion of the same juke box.

The turntable is powered by a motor 27 with a shaft having a pulley 29. The pulley 29 is connected by means of a silicone belt 31 to a larger pulley 33 located below the surface of turntable 9. The pulleys act as a gear reduction system to slow down the speed of the turntable. In the preferred embodiment, a Mabuchi Motor FA-260RA-2295 is used at 3 volts. FIG. 9 is an exploded view of a portion of the invention including these features.

As can best be seen in FIG. 3, a battery case 35 is provided in the housing. The motor is activated either by a "try me switch" or by external sound received by a microphone 39 of sound-responsive activating means. The microphone 39 is located in the bottom of the base so as to minimize disturbances from the sound of the dancing figure itself. Sound is transmitted to microphone 39 because the base of the juke box is raised on the legs 5. When the try me switch 37 is turned on, this activates a mini-speaker 41 so that the dancing figure will operate for a short period of time, such as for example, thirty seconds, using pre-programmmed music. When the juke box is in "try me mode", it is not activated by external sounds until the try me button 37 is pushed and then operates only for the pre-selected short time period.

Figure 8:
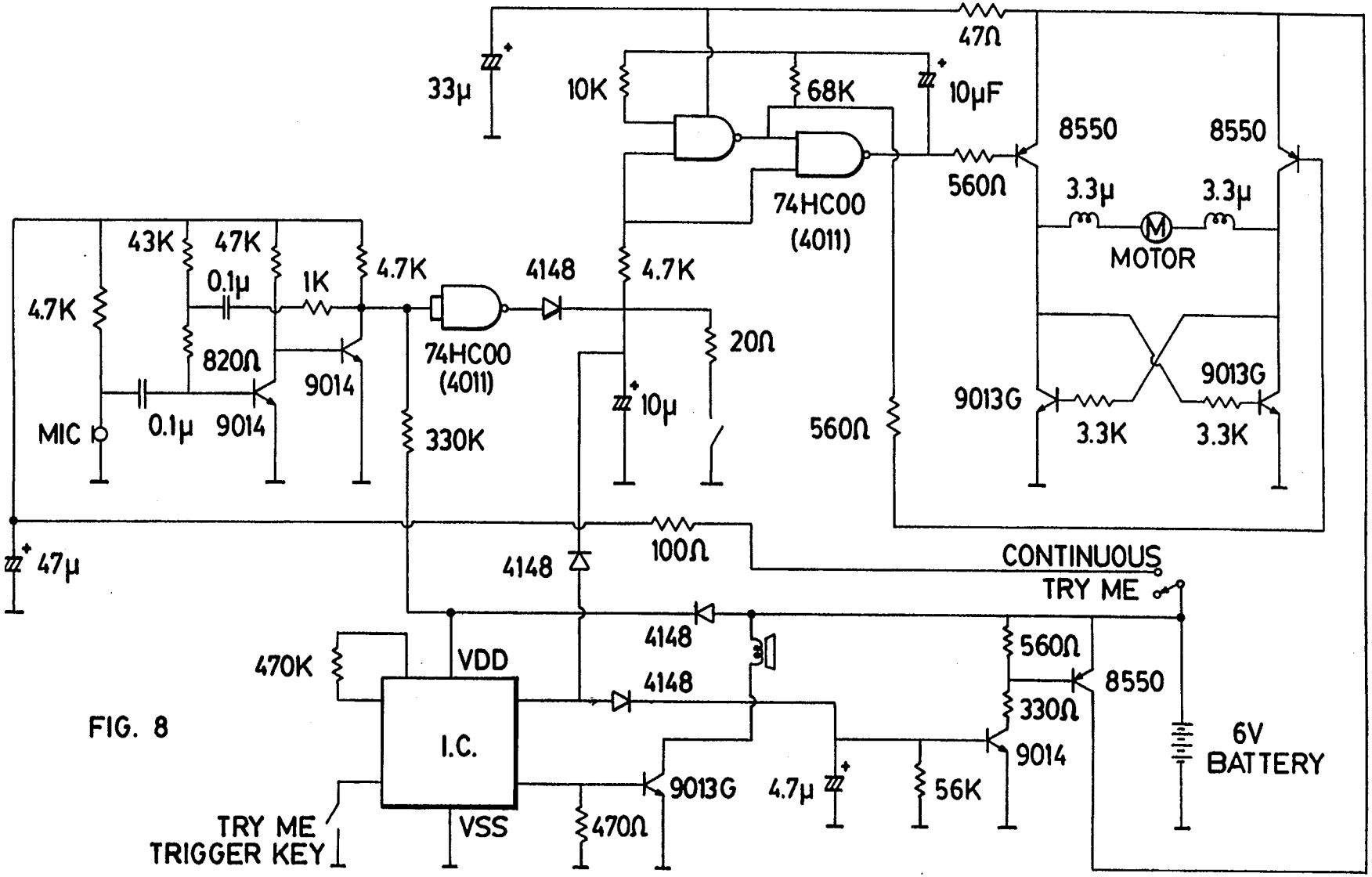
FIG. 8 is a circuit diagram for operating the toy of the invention.

A switch on the bottom of the juke box (not shown) allows switching into a sound activated mode whereby the motor is activated by any external sound source. An integrated circuit 40 connected to the sound-responsive activating means drives the motor. A circuit that will operate the preferred embodiment is shown in FIG. 8.

Figure 2:
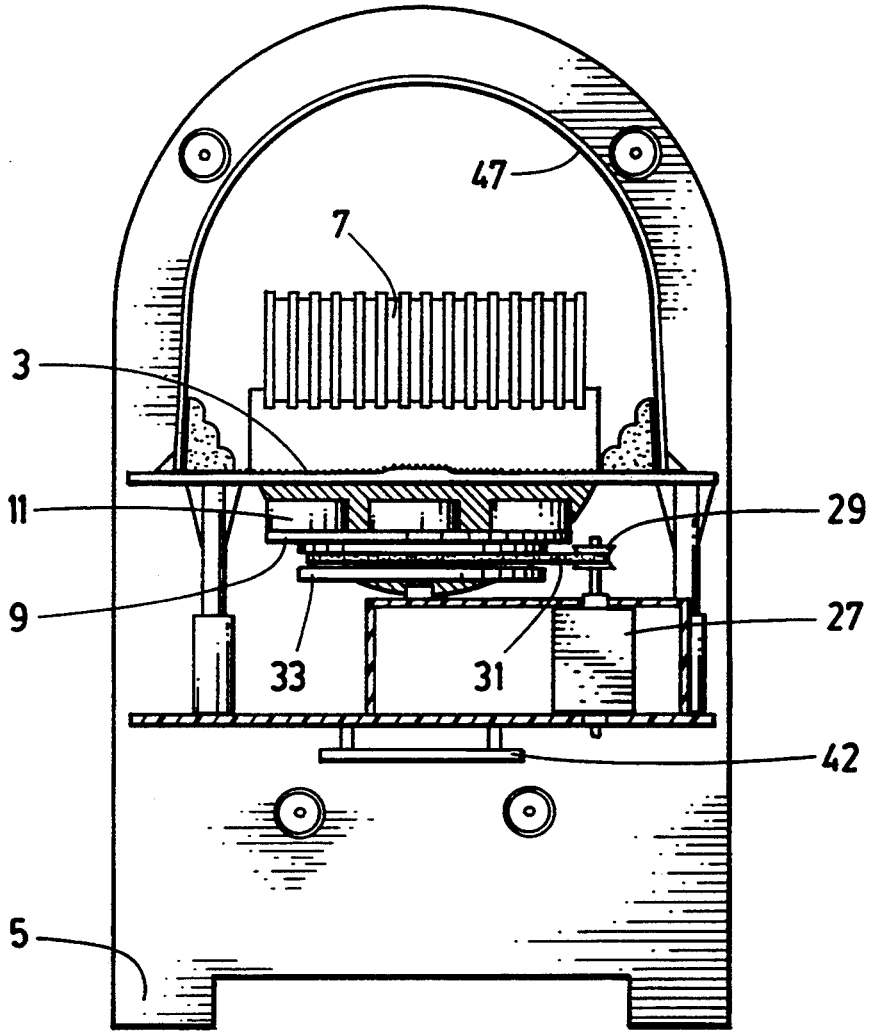
FIG. 2 is a front sectional view of a toy juke box containing a dancing stage.
Figure 3:
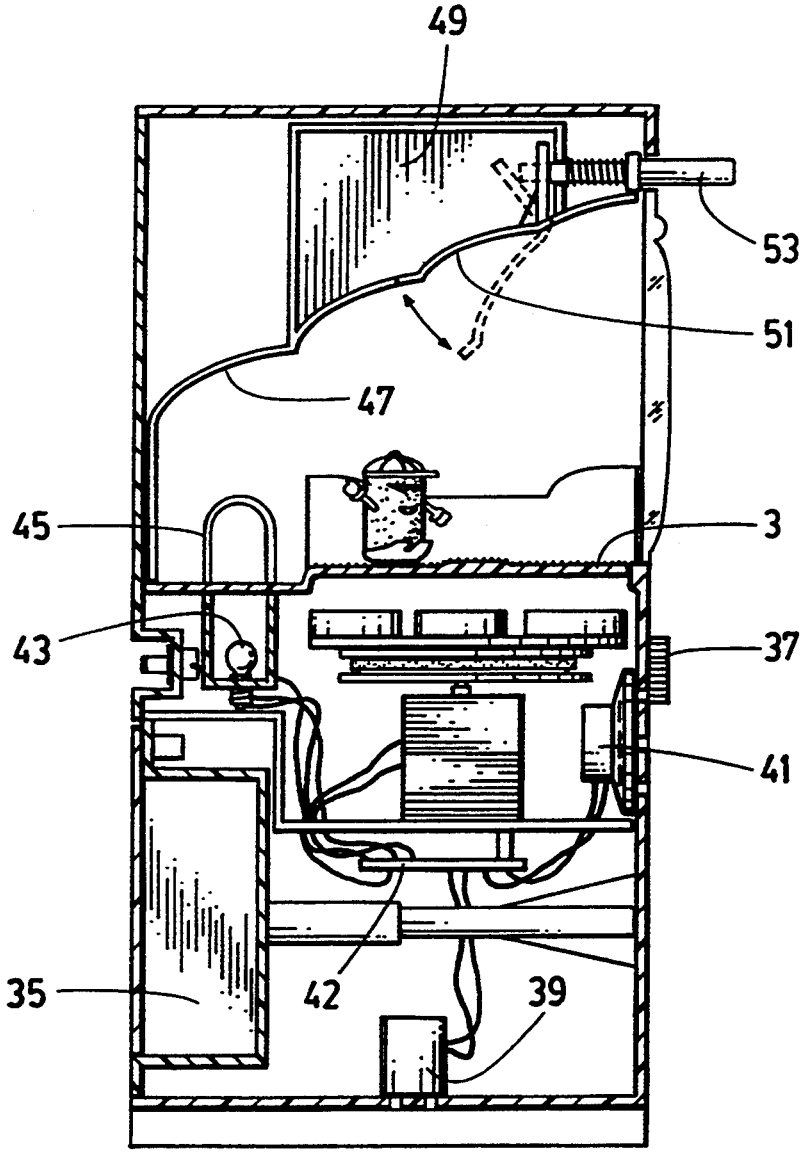
FIG. 3 is a side sectional view of the same juke box.

A light 43 can be turned on so that light rays pass through transparent cover 45 reflecting off the back of the dancing stage by means of reflectors 47, which are shown in FIG. 2.

In order to protect the dancing FIG. 1 during shipment, storage box 49 is provided in a recess of the juke box above the dancing stage. The box 49 contains a door 51 which releases the dancing figure upon pressing button 53. In addition the dancing figure can be stored for further transportation by reopening the door and turning the juke box upside down, allowing the figure to fall into the transportation box 49.

It will be understood that the foregoing disclosed embodiments are illustrative of the invention, and that modifications thereto can be made, within the scope of the claims appended hereto.

What is claimed is:

1. A toy with dancing figure comprising:

(i) a housing;

(ii) a dancing stage mounted on the housing, the stage having a rough, friction causing upper surface;

(iii) a turntable rotatably mounted about its centre in the housing below the dancing stage and rotating in a plane parallel to the plane of the stage;

(iv) a first magnet attached to the turntable at a point radially outward from the centre of rotation of the turntable, the first magnet's poles being oriented along a line substantially perpendicular to the plane of the stage, wherein the turntable is balanced to accommodate the mass of the first magnet in the distribution of mass on the turntable so that the centrifugal forces of the turntable are substantially equal about the axis of rotation of the turntable;

(v) a dancing figure having at its base a second magnet with the poles of the second magnet oriented along a line perpendicular to the plane of the dancing stage when the figure is upright and with the polarity of the second magnet oriented in a direction relative to the polarity of the first magnet so that the first magnet and the second magnet attract each other at their opposite poles;

(vi) means for turning the turntable; and (vii) means for activating the turntable turning means;

wherein the figure is attracted to but does not precisely follow the first magnet; and wherein the figure falls down and is righted in response to magnetic force.

2. The toy of claim 1, wherein pieces in addition to the first magnet are attached to the turntable such that the centrifugal forces of the turntable are substantially equal about the axis of rotation of the turntable.

3. The toy of claim 2, wherein the pieces attached to the turntable are of metal and the metal pieces are capable of being attracted by and attracting a magnet.

4. The toy of claim 1, wherein the activating means is a switch.

5. The toy of claim 1, wherein the activating means is sound-responsive means.

6. The toy of claim 3, wherein the activating means is a switch.

7. The toy of claim 3, wherein the activating means is sound-responsive means.

8. The toy of claim 3, wherein at least some of the metal pieces are also magnets.

* * * * *

UNITED STATES PATENT AND TRADEMARK OFFICE

CERTIFICATE OF CORRECTION

PATENT NO. : 5,417,605

DATED : May 23, 1995

INVENTOR(S) : Chan

It is certified that error appears in the above-indentified patent and that said Letters Patent is hereby corrected as shown below:

In the abstract of the Patent, line 4, change "stage" to --stage,--; and line 9, change "am" to --are--.

In column 1, line 34 of the Patent, change "tall" to --fall--.

In column 3, line 10 of the Patent, change "FIG. 1 oil" to --figure 1 on--;

line 16, change "FIG. 1." to --figure 1.--; and line 49, change "FIG. 1" to --figure 1--.

UNITED STATES PATENT AND TRADEMARK OFFICE

CERTIFICATE OF CORRECTION

PATENT NO. : 5,417,605

DATED : May 23, 1995

INVENTOR(S) : Chan

It is certified that error appears in the above-indentified patent and that said Letters Patent is hereby corrected as shown below:

In column 4, line 8 of the Patent, change "FIG. 1" to --figure 1--.

line 27, after "switch"" insert --37--;

line 44, change "40" to --42--; and line 52, change "FIG. 1" to --figure 1--.

Signed and Sealed this

Eighteenth Day of July, 1995

*Attest:*

*Attesting Officer*

BRUCE LEHMAN

*Commissioner of Patents and Trademarks*